US007810264B2

(12) United States Patent
Vait et al.

(10) Patent No.: US 7,810,264 B2
(45) Date of Patent: Oct. 12, 2010

(54) FLAG WARNING SYSTEM AND METHOD TO USE

(76) Inventors: Tom Vait, 205 Teakwood La., Lewisville, TX (US) 75067; Mike Vait, 900 2nd St. SE., Fairfax, MN (US) 55332; Leroy Vait, 65215 510 St., Fairfax, MN (US) 55332

( * ) Notice: Subject to any disclaimer, the term of this patent is extended or adjusted under 35 U.S.C. 154(b) by 329 days.

(21) Appl. No.: 12/103,203

(22) Filed: Apr. 15, 2008

(65) Prior Publication Data

US 2009/0255158 A1 Oct. 15, 2009

(51) Int. Cl.
*G09F 15/00* (2006.01)

(52) U.S. Cl. ..... 40/606.14; 40/606.15

(58) Field of Classification Search ..... 40/590, 40/601, 606.14, 606.15, 608, 607.04; 116/28 R, 116/30, 209, 173; 248/291.1
See application file for complete search history.

(56) References Cited

U.S. PATENT DOCUMENTS 4,073,082 A 2/1978 McWhorter
4,122,629 A 10/1978 Rennick
4,680,571 A * 7/1987 Keklak et al. ..... 340/463
4,713,910 A 12/1987 Quante
4,843,373 A * 6/1989 Trickle et al. ..... 340/540
4,901,071 A 2/1990 Fletcher
5,146,710 A 9/1992 Caldwell
5,377,945 A * 1/1995 Steinke ..... 248/292.11
5,546,623 A * 8/1996 Hahn ..... 14/69.5
5,964,059 A 10/1999 Metz
6,195,925 B1 3/2001 Werner
6,312,214 B1 11/2001 Nowak et al.
2005/0146440 A1* 7/2005 Dang ..... 340/686.1
2005/0252439 A1* 11/2005 Payson ..... 116/303
2008/0282964 A1* 11/2008 Bennett ..... 116/28 R

* cited by examiner

*Primary Examiner*—Gary C Hoge
(74) *Attorney, Agent, or Firm*—Lawrence J. Gibney, Jr.

(57) ABSTRACT

A flag warning system is paramount because it increases the safety of a dock-loading area. Often times, workers and machinery are moving in and out of trailers to either load or unload trailers, and it is important to insure that the truck is not moved inadvertently, thereby preventing damage to individuals and equipment. This is a simple dock warning system that will alert the driver by simply rotating a flag so that the flag is either visible or not visible to alert the driver to move or not move the trailer. When the flag is visible to the driver when he or she looks in the rearview mirror, the load is safe to be pulled. If the driver does not see the flag, he or she should not pull the load.

12 Claims, 5 Drawing Sheets

FLAG WARNING SYSTEM AND METHOD TO USE

BACKGROUND OF THE INVENTION

A. Field of the Invention

This relates to dock safety and insuring that a truck and trailer combination is safely moved after the loading or unloading of the trailer. The loading and unloading of a trailer is frequently accomplished at a loading dock. As the workers load or unload a trailer, it is imperative that the truck that is attached to the trailer not be allowed to move to avoid the risk of personal injury. This device is a simple way to inform the driver when not to move the trailer and when the trailer can be safely moved.

B. Prior Art

There are many other prior art references to dock warning systems and a representative example of this can be found at Metz, U.S. Pat. No. 5,964,059. This patent teaches a safety pole that is positioned in the front of the vehicle and is controlled by a motor driven drum.

Nowak, U.S. Pat. No. 6,312,214 is another patent that teaches a method for improving safety in the loading or unloading process. However, this system uses an actuator with a plurality of different colored lights that controls the operation and movement of a barrier in the front of the truck cab.

Another dock safety apparatus includes Rennick and can be found at U.S. Pat. No. 4,122,629. Again, this is also a way to alert a driver when to move or not to move but uses an electrical system that controls the movement of a gate positioned near the rear of the trailer. An electrical switch positioned on a chock against which one of the tires of trailer rests controls the operation of the switch.

The current device is different than the prior art because the current device uses a mechanical apparatus to warn a driver and to advise a driver when the truck and trailer combination can be safely moved. An important feature of the current device is that the worker must physically pull the flag and block the entrance to the trailer prior to the trailer being allowed to move. This device is a mechanical device and does not rely on the operation of any electrical circuitry to operate the system. The worker is personally responsible for signaling when a move may be safe.

BRIEF SUMMARY OF THE INVENTION

This is a device and a method to control the safe loading or unloading of a trailer on a loading dock. Trailers are frequently backed into the loading dock to be loaded or unloaded. Workers in the back of the trailer physically unload the trailer. It is imperative that the truck and trailer not be allowed to move before it is safe to minimize the risk of personal injury to the workers in the trailer.

Loading docks are typically structures that are raised to accommodate the height of the trailer and usually have a bumper system on the front to protect against excess wear and tear on the loading dock. At times, in addition, to the workers moving in and out of the trailer, pieces of equipment such as dollies, pallet jacks and forklifts may routinely enter and exit the trailer.

This device is comprised of a set of safety flags, which are attached to a pole. The pole is secured to the loading dock probably on the side of the bumper system that can be found on many different docks or warehouse areas. The system will have a flag at one end and a pole with a handle at the other end.

When no trailer is positioned to be loaded or unloaded on the dock area, the flag with the pole will hang vertically from the bumper system of the dock system. After the trailer is positioned to be loaded or unloaded, the flag will not interfere with the normal loading or unloading process because the pole handle will be positioned below the loading dock surface.

After the trailer is loaded or unloaded and ready to be moved, the pole with the attached flag is pulled upward and tilted so that a portion of the pole prevents the trailer door from opening. This deployed position also places the flag at a slight angle relative to the dock.

The positioning of the flag, when it is deployed, will also be visible from the mirror system of the truck. Unless the driver sees the flag, the driver is instructed not to move the load. When the flags are not deployed they are not visible from the mirror system of the truck. If the trucker does not see the flag, he or she is instructed not to move the truck.

One of the advantages of this system is that the individual who is loading and unloading a trailer can control the movement of the truck simply by raising and lowering the flag system. The flag system has been constructed so that the trailer doors must be closed before the flag system can be deployed i.e. lifted to become visible, so as to alert the driver that it is safe to move the vehicle forward.

DETAILED DESCRIPTION OF THE EMBODIMENTS

Figure 2:
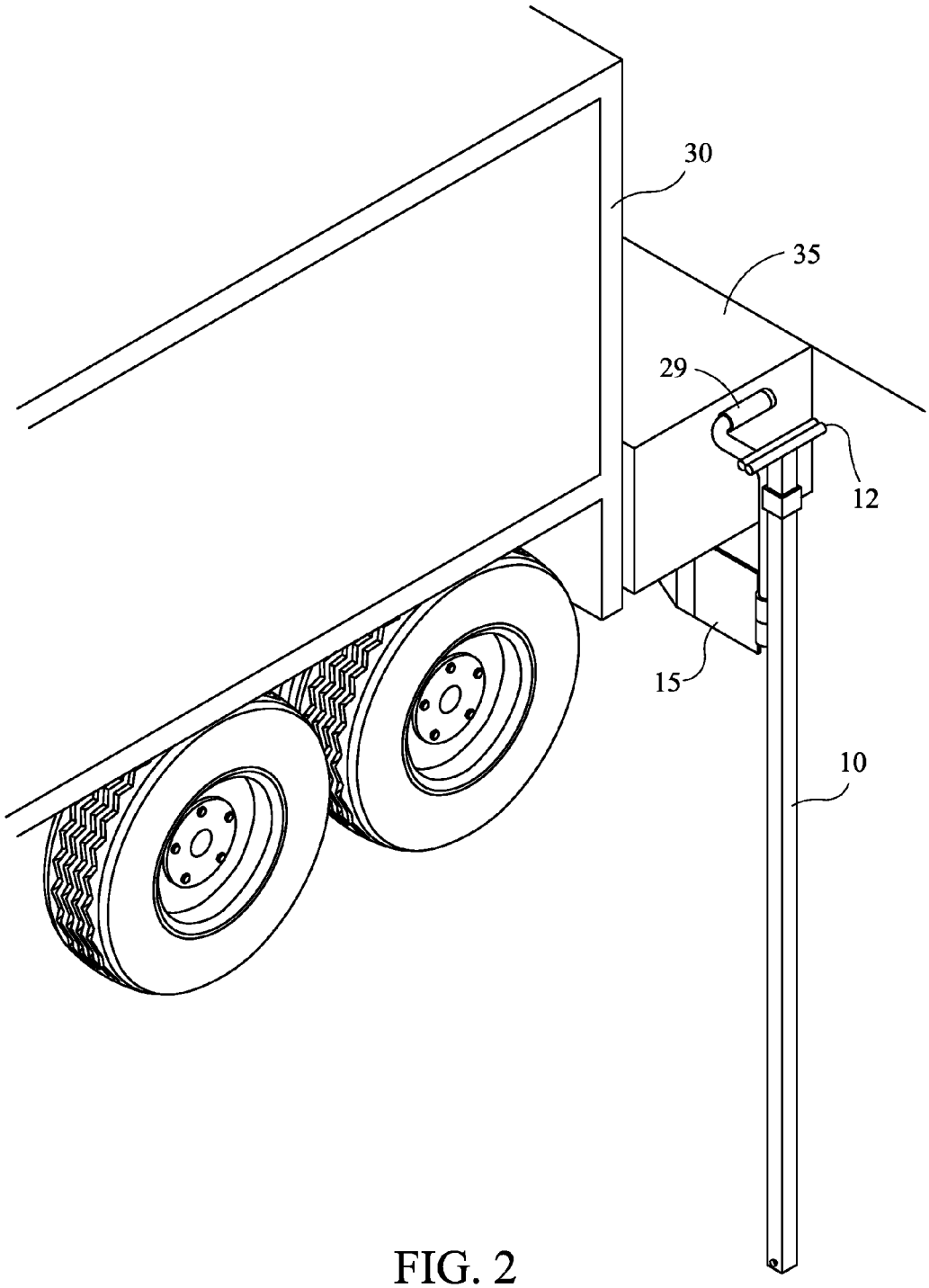
FIG. 2 is an isometric view of the device installed on the loading dock with the device not deployed.
Figure 3:
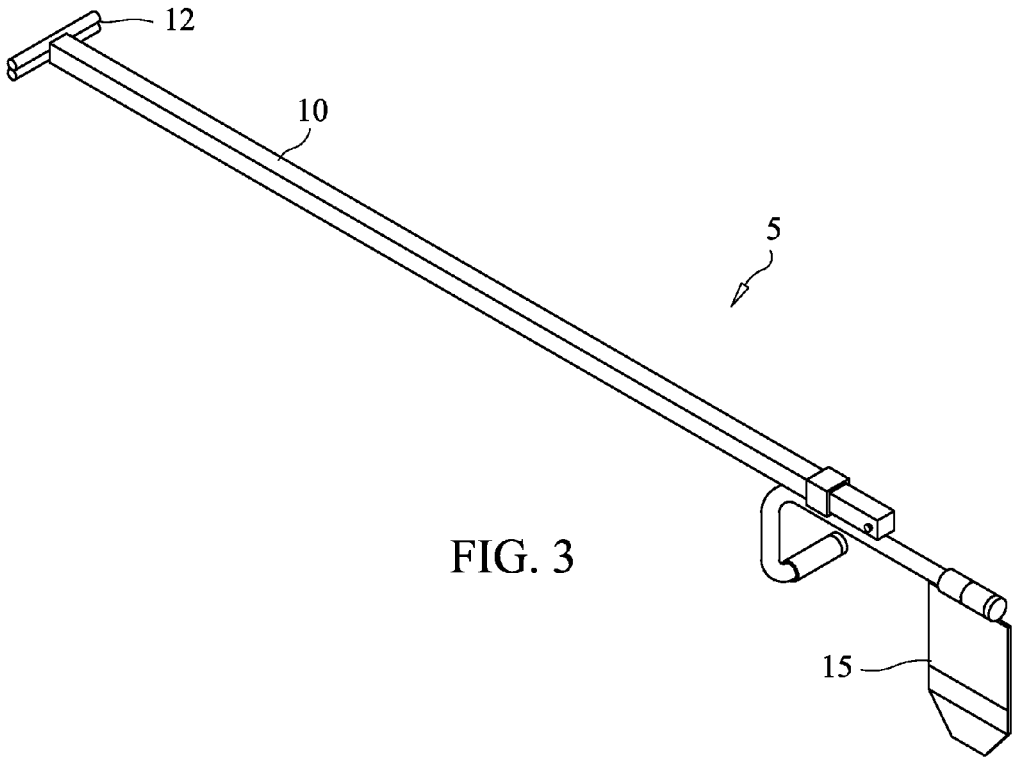
FIG. 3 is an isometric view of the device assembled.

The device 5 is comprised of a pole 10, a handle 12, a flag 15, and a means to connect the flag 15 to the pole 10. The flag assembly 20 secures the flag 15 and the pole 10 to a portion of the loading dock such as depicted in FIG. 2.

The flag 15 is placed on the flag assembly 20 by inserting it over the flag tubular member 24. A pole fitting 25 is placed on the side of the flag assembly to connect the pole 10 to the device. The pole will be allowed to slide within the pole fitting 25. Although the pole 10 and flag assembly fitting 25 are depicted as square in FIG. 1, the pole and flag assembly fitting may also be circular or any other geometric shape.

The flag assembly 20 is one piece with a upper horizontal member 23 connected to the mid-section 26 at approximately ninety degrees followed by a flag tubular member 24.

Figure 1:
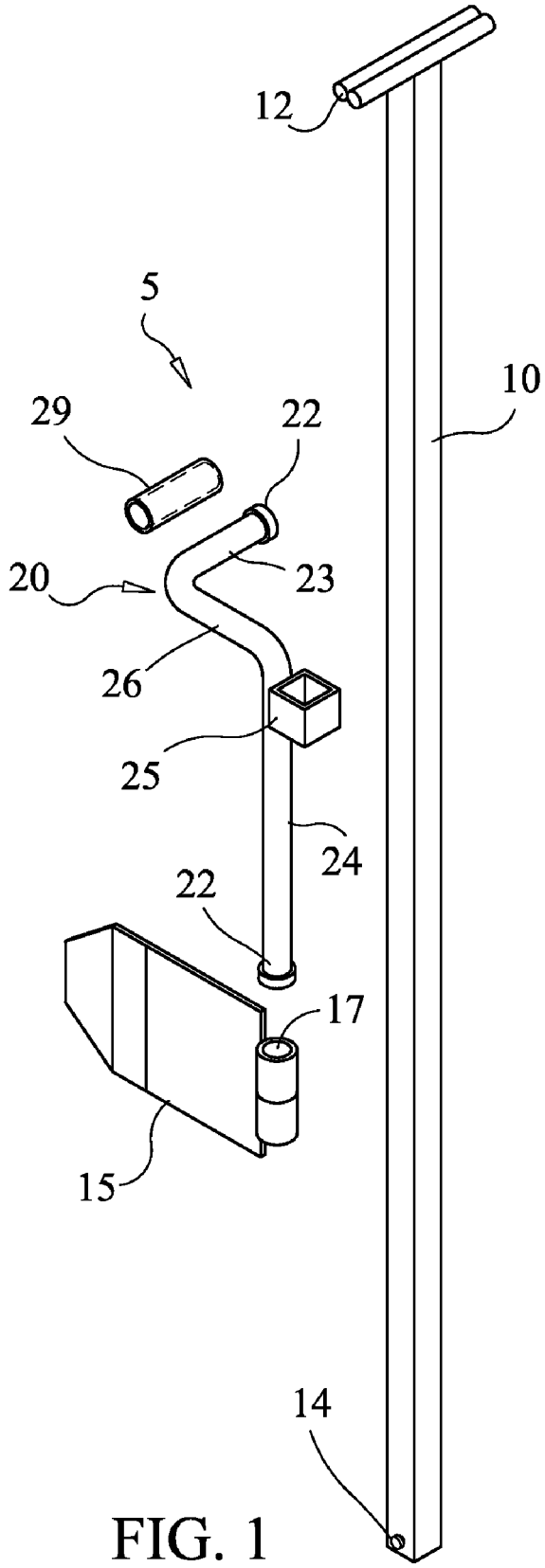
FIG. 1 is an isometric view of this device showing the separate parts.

The flag 15 is secured to the flag tubular member 24 using an attached hollow flag bushing 17 that is placed on the flag tubular member 24. In order to prevent the flag bushing 17 from sliding off the flag tubular member 24, a stop mechanism 22 on the flag tubular member 24 is provided on both ends of the flag assembly. This tubular stop mechanism 22 is either a threaded flange, threaded lock nut or flared ends or similar means as depicted in FIG. 1. The flag bushing 17 allows the flag 15 to move while the tubular stop mechanism 22 prevents the flag 15 from slipping off the flag tubular member 24.

Figure 4:
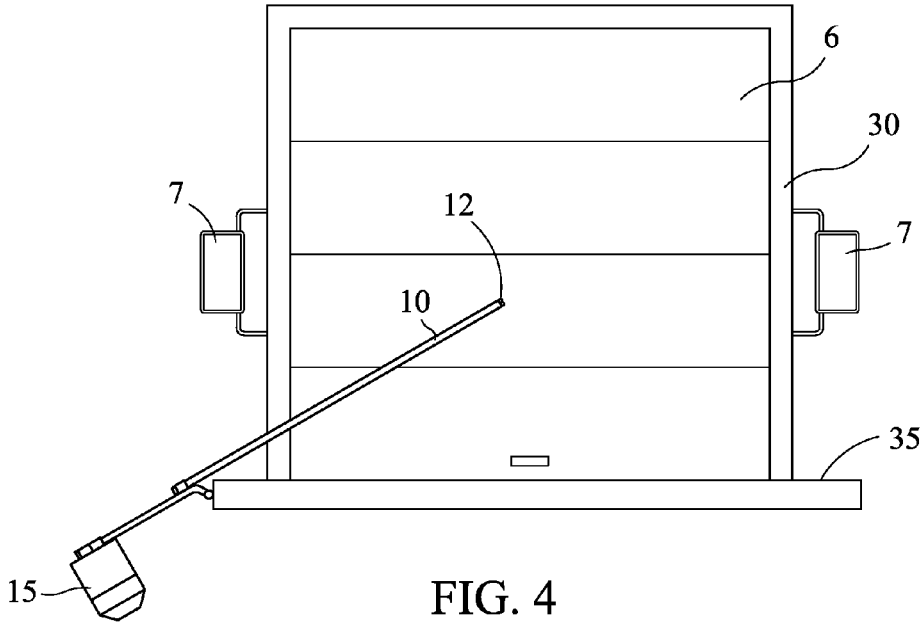
FIG. 4 is a view of the device when it is deployed with a view from the loading dock viewing the back of the trailer showing the rear view mirrors of the cab.
Figure 5:
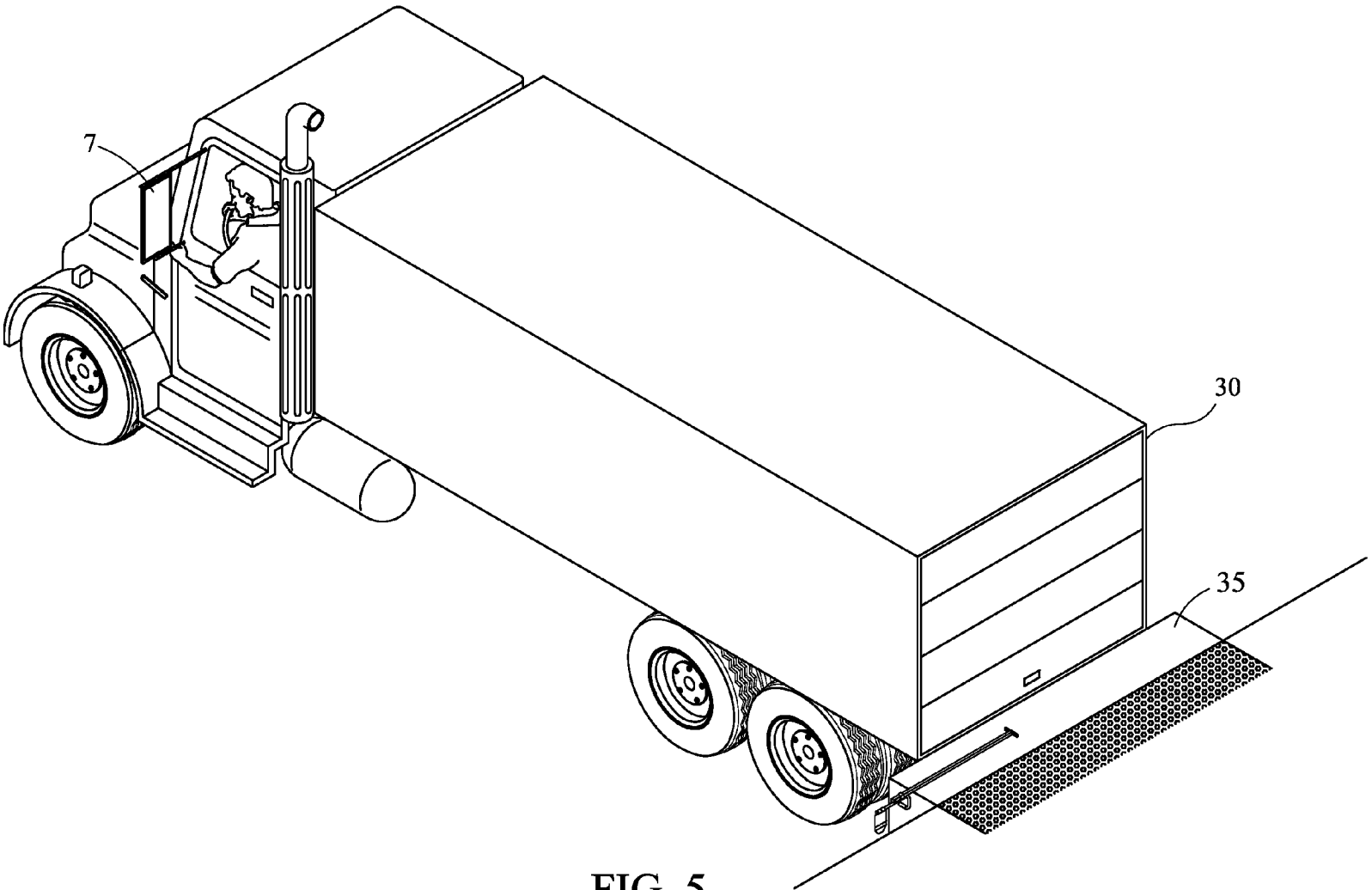
FIG. 5 is an isometric view of a truck cab and trailer combination positioned at the dock with the flag visible from the mirror of the truck.
Figure 6:
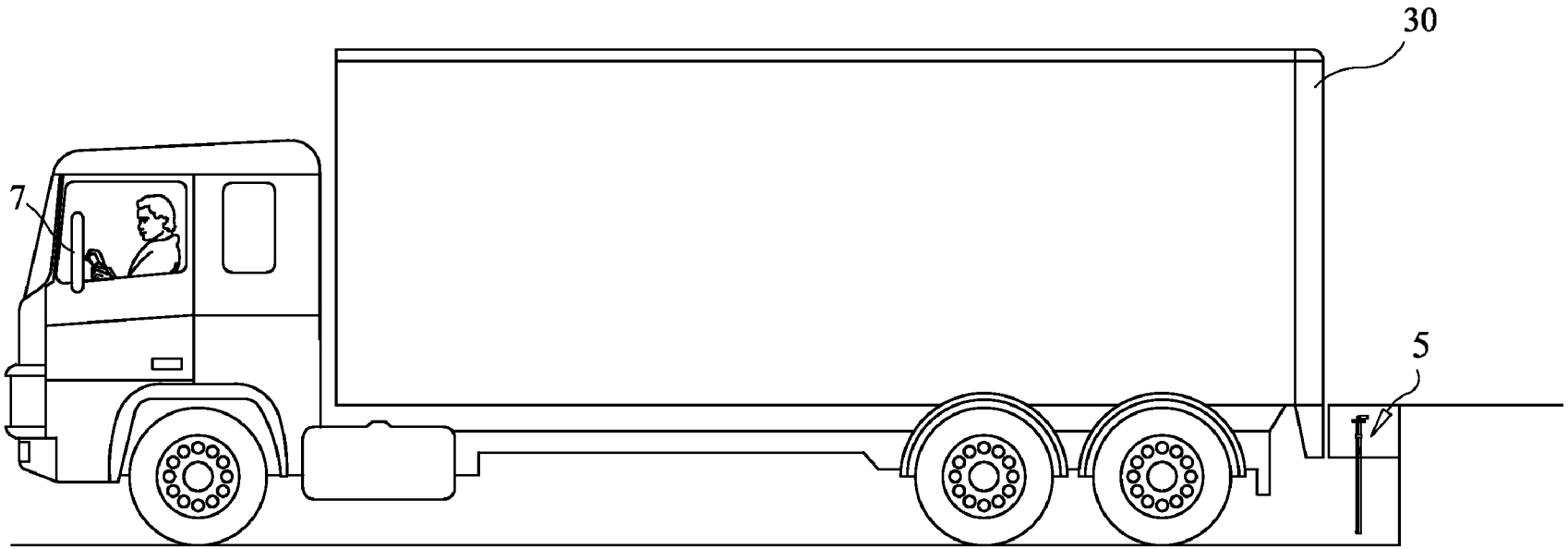
FIG. 6 is a side view of a truck cab and trailer combination positioned at the dock with the flag not visible from the mirror of the truck.

A loading dock bushing 29 is placed on the upper horizontal member 23 and allows the entire flag assembly to rotate. A stop mechanism on the end of the upper horizontal member prevents the device 5 from sliding out. The docking bushing 29 is secured to the loading dock probably by welding and allows the assembly to rotate a predetermined amount such as depicted in FIGS. 4 and 5. In order to make the system as hands free as possible, once the flag is positioned such as depicted in FIG. 4 or 5 the flag will remain in place until moved by a person to the vertical position.

A pole stop mechanism 14, which is probably a raised protrusion on the outside surface of the pole, is placed on one end of the pole 10 to prevent the pole 10 from being pulled through the pole fitting 25. As the pole 10 is pulled upward through the pole fitting 25, the pole 10 will be prevented from moving beyond a predetermined point and this will enable the user to tilt the flag in a position such as depicted in FIG. 4.

In operation, a trailer 30 is backed up to the loading dock 35 for the purpose of loading and/or unloading. This device is installed on the side of the bumper system on the loading dock as depicted in FIG. 2.

The pole 10 will extend vertically through the pole fitting 25 and the flag 15 and is not visible by the driver when it is not deployed such as shown in FIG. 2. When the flag 15 is not visible through the rear view mirrors 7, this is an indication that the driver should not move the trailer. When it is safe to move the trailer 30 the workers will close the trailer doors 6 and grab the handle 12 that is attached to the pole 10. The worker then pulls the handle 12 and positions the flag as depicted in FIG. 4 so that the flag is readily visible to the driver by simply looking in the truck's rearview mirror 7.

In one embodiment the pole 10 is allowed to telescope within the attached pole fitting 25. In the alternative embodiment (not depicted), the flag 15 may be secured directly to the end of the pole and may move as the pole move through the pole fitting 25.

In either system, the device is attached to the side of a loading dock facility. When it is safe to move, the flag is extended outward such as depicted in FIGS. 4 and 5. In this configuration, the driver of the vehicle is able to view the flag he or she knows that the trailer can be safely moved.

Additionally, the pole and handle 10, 12 blocks the trailer doors 6 such as depicted in FIG. 4 to insure that the trailer is safe to be moved and that the workers are not in any danger. Although not depicted in FIG. 4, this system may be positioned on both sides of the loading dock. In that case the driver must see both flags in order to move the load.

The invention claimed is:

1. A dock warning system, which is comprised of:
a pole;
wherein the pole is of a predetermined length;
wherein the pole has a first end and a second end;
wherein a handle is provided on the first end of the pole;
wherein a stop mechanism is provided on the second end of the pole;
a. flag assembly;
wherein the flag assembly is one piece;
wherein the flag assembly has an upper horizontal member;
wherein the flag assembly has a mid-section;
wherein the flag assembly has a flag tubular member;
wherein a pole fitting is provided to secure the flag assembly to the pole;
wherein the pole slides within the pole fitting;
wherein the flag tubular member secures a flag;
wherein a stop mechanism is placed on an end of the flag tubular member;
wherein a loading dock bushing is provided to secure the flag assembly to the loading dock;
wherein the loading dock bushing is secured to the loading dock;
wherein the loading dock bushing provides rotation of the device;
wherein a flag bushing to secure the flag is provided;
said bushing is placed over the flag tubular member;
wherein the flag is secured to a portion of the flag bushing;
said flag is of a predetermined shape;
said flag is clearly visible when deployed;
wherein the flag is allowed to rotate.

2. The device as described in claim 1 wherein the pole and pole fitting are square.

3. The device as described in claim 1 wherein the stop mechanism for the tubular member is a lock nut.

4. The device as described in claim 1 wherein the stop mechanism for the tubular member is a flange.

5. The device as described in claim 1 wherein the stop mechanism for the tubular member are flared ends.

6. The device as described in claim 1 wherein the stop mechanism for the pole is a raised protrusion.

7. A method to use the device as described in claim 1 which is comprised of the following steps:
a. grabbing the handle;
b. pulling the handle upward;
c. rotating the handle a predetermined amount so that the flag extends outward at a predetermined location.

8. A dock warning system, which is comprised of:
a pole;
wherein the pole is of a predetermined length;
wherein the pole has a first end and a second end;
wherein a handle is provided on the first end of the pole;
wherein a stop mechanism is provided on the second end of the pole;
a. flag assembly;
wherein the flag assembly is one piece;
wherein the flag assembly has an upper horizontal member;
wherein the flag assembly has a mid-section;
wherein a pole fitting is provided to secure the flag assembly to the pole;
wherein a tubular member is provided;
wherein the pole slides within the pole fitting;
wherein a loading dock bushing is provided to secure the flag assembly to the loading dock;
wherein the loading dock bushing is secured to the loading dock;
wherein the loading dock bushing provides rotation of the device;
wherein a flag is secured to a portion of the flag assembly;
said flag is of a predetermined shape;
said flag is clearly visible when deployed.

9. The device as described in claim 8 wherein the pole and pole fitting are square.

10. The device as described in claim 8 wherein the stop mechanism for the tubular member is a lock nut.

11. The device as described in claim 8 wherein the stop mechanism for the tubular member is a flange.

12. The device as described in claim 8 wherein the stop mechanism for the tubular member are flared ends.

* * * * *